United States Patent [19]

Mishima

[11] 4,256,005

[45] Mar. 17, 1981

[54] RHYTHM GENERATOR

[75] Inventor: Toshio Mishima, Kitamoto, Japan

[73] Assignee: Kabushiki Kaisha Kawai Gakki Seisakusho, Hamamatsu, Japan

[21] Appl. No.: 61,768

[22] Filed: Jul. 30, 1979

[30] Foreign Application Priority Data

Aug. 11, 1978 [JP] Japan ..... 53/98043

[51] Int. Cl.[3] ..... G10F 1/00

[52] U.S. Cl. ..... 84/1.03; 84/DIG. 12

[58] Field of Search ..... 84/1.03, DIG. 12

[56] References Cited

U.S. PATENT DOCUMENTS

| | | | |
|---|---|---|---|
| 3,813,472 | 5/1974 | Hirano | 84/1.03 |
| 3,958,483 | 5/1976 | Borrevik et al. | 84/DIG. 12 |
| 3,972,258 | 8/1976 | Adachi | 84/DIG. 12 |
| 4,089,245 | 5/1978 | Dietrich | 84/DIG. 12 |
| 4,154,132 | 5/1979 | Mishima | 84/DIG. 12 |

*Primary Examiner*—Gene Z. Rubinson
*Assistant Examiner*—Forester W. Isen

[57] ABSTRACT

A rhythm generator which is provided with a plurality of rhythm pattern memories, each storing one rhythm pattern and outputting the rhythm pattern in response to a rhythm clock, a bar counter for counting the number of bars with the rhythm clock, and means supplied with the output from the bar counter to selectively assign desired ones of the rhythm pattern memories one after another for a desired number of bars.

1 Claim, 1 Drawing Figure

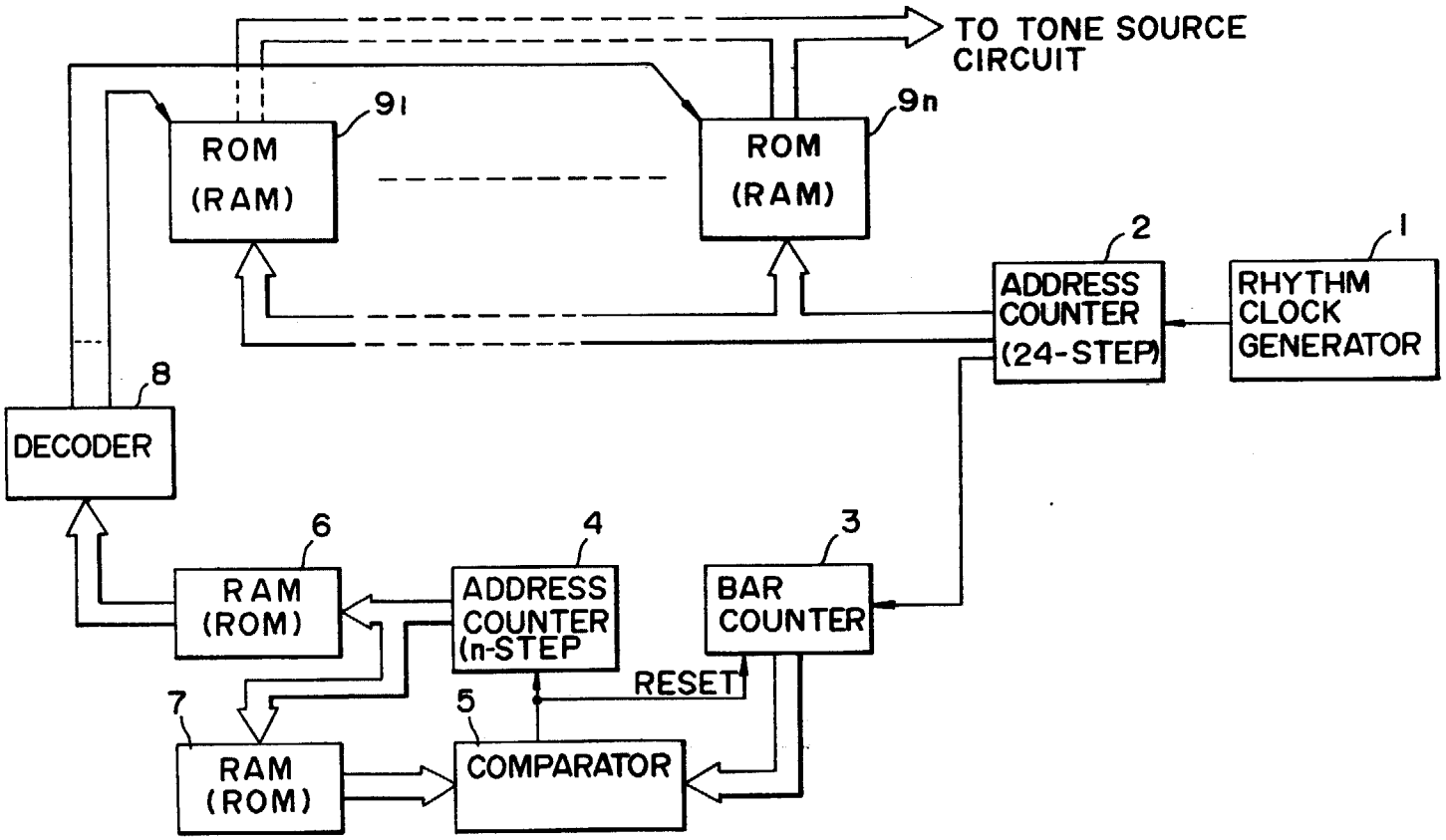
TO TONE SOURCE CIRCUIT
1
RHYTHM CLOCK GENERATOR
2
ADDRESS COUNTER (24-STEP)
9n
ROM (RAM)
9l
ROM (RAM)
3
BAR COUNTER
RESET
4
ADDRESS COUNTER (n-STEP)
5
COMPARATOR
6
RAM (ROM)
7
RAM (ROM)
8
DECODER

RHYTHM GENERATOR

BACKGROUND OF THE INVENTION

1. Field of The Invention

This invention relates to a rhythm generator which is adapted so that desired rhythm patterns, each corresponding to one bar, are automatically generated in a sequential order over a desired number of bars during playing of a tune.

2. Description of the Prior Art

Conventional rhythm generators usually generate one selected rhythm repeatedly throughout a tune being played. In practice, however, substantially no tunes are played in the same rhythm pattern; in general, they are played inserting some variations of the selected rhlythm at proper intervals. Hence the rhythm produced by the conventional rhythm generators inevitably feels monotonous.

To avoid such monotony, there has recently been proposed a rhythm generator capable of producing variations of a rhythm, but the variations are automatically switched at equal time intervals or manually at desired times. In the former case, however, the rhythms are each repeated on the same cycle and hence still feel monotonous, though less monotous than in the past, and in the latter case such manual operation is difficult for a player using his both hands and feet during playing.

SUMMARY OF THE INVENTION

This invention is to provide a rhythm generator which solves the abovesaid problems of the prior art and which is designed so that rhythm patterns and their repetitive frequencies are freely selected and combined in a sequential order and that the combined rhythm patterns are automatically generated.

The above object is achieved by providing a rhythm generator which comprises a plurality of rhythm pattern memories, each storing one rhythm pattern and outputting the rhythm pattern in response to a rhythm clock, a bar counter for counting the number of bars with the rhythm clock, and means supplied with the output from the bar counter to selectively assign desired ones of the rhythm pattern memories one after another for a desired number of bars.

BRIEF DESCRIPTION OF THE DRAWING

The accompanying drawing is an explanatory diagram illustrating the constuction of an embodiment of this invention.

DESCRIPTION OF THE PREFERRED EMBODIMENT

In the drawing, each of rhythm pattern memories ROM(RAM)$9_1$ to $9_n$ stores a rhythm pattern for each bar and provides its output to a tone source circuit in response to addressing by a rhythm clock. It is prestored in a selecting memory RAM(ROM)6 in what order the memories ROM(RAM)$9_1$ to $9_n$ are to be selected, and the number of bars over which the rhythm pattern or patterns stored in the memory 6 are to be repeated is also prestored in a memory RAM(ROM)7. Rhythm clock pulses from a rhythm clock generator 1 are applied to an address counter 2 for addressing the memories $9_1$ to $9_n$. For example, if the address counter 2 is a 24-step counter, then the number of bits required for the memories $9_1$ to $9_n$ is $(24\times m)$ bits, where m is the number of tone sources. Where 24 clock pulses correspond to one bar, a bar counter 3 advances by one bit every 24 clock pulses and the output from the bar counter 3 is compared by a comparator 5 with the number of outputs from the bar number memory 7. The bar counter 3 continues counting until its output coincides with the output from the memory 7. In the case of coincidence, the comparator 5 applies a coincidence signal to an address counter 4 for counting and its count value is provided to the selecting memory 6 and the bar number memory 7 to read out their contents. The count value of the address counter 4 is equal to the number of rhythm pattern changes n in one tune, that is, the word number n of the bar number memory 7.

The content of the selecting memory 6 is subjected to code conversion by a decoder 8 and applied to the memories $9_1$ to $9_n$ to read out their contents for input to a tone source circuit.

The operation of the above arrangement will hereinafter be described in concrete terms.

In the case of playing a tune, for example, in the rhythm pattern of the memory $9_1$ for first two bars, the rhythm pattern of the memory $9_2$ for the next three bars, the rhythm pattern of the memory $9_1$ for the next one bar, . . . , the order of selection of the rhythm pattern memories $9_1$ to $9_n$ and the numbers of bars, that is, 2, 3, 1, . . . in this case, are prestored in the selecting memory 6 and the bar number memory 7, respectively.

During playing the address counter 2 counts the rhythm clock pulses yielded from the rhythm clock generator 1 and inputs addresses to the memories $9_1$ to $9_n$. At that time, a signal (0, 0, 0) is applied from the address counter 4 to the selecting memory 6, from which a signal is provided via the decoder 8 to the memory $9_1$ to actuate it. Having counted 2 applies one pulse to the bar counter 3. When the address counter 2 has counted 24 clock pulses again, it provides another pulse to the bar counter 3 to derive therefrom a signal (0, 1, 0). The bar number memory 7 is supplied first with the signal (0, 0, 0) from the address counter 4, so that the bar number memory 7 applies a signal (0, 1, 0) to the comparator 5. Then, the output signals from the bar number memory 7 and the bar counter 3 coincide, and the comparator 5 provides one coincidence signal to the address counter 4 to drive therefrom an output signal (0, 0, 1) and, at the same time, supplies a reset signal to the bar counter 3. And the bar number memory 7 is supplied with the output signal (0, 0, 1) from the address counter 4 to provide an output signal (0, 1, 1).

The selecting memory 6 is supplied with the signal (0, 0, 1) from the address counter 4 to activate the rhythm pattern memory $9_2$, and the rhythm pattern stored in the memory $9_2$ is read out therefrom by an address signal from the address counter 2 and applied to the tone source circuit.

Next, when three pulses have been applied from the address counter 2 to the bar counter 3 to derive therefrom a signal (0, 1, 1), since this output signal coincides with the output signal from the bar number memory 7, the comparator 5 applies a coincidence signal to the address counter 4 to advance its count value by one. As a consequence, the bar number memory 7 produces a signal (0, 0, 1), and the selecting memory 6 activates the rhythm pattern memory $9_3$ via the decoder 8. Thereafter, the same operations as described above are carried out for each selected rhythm pattern.

In the above embodiment, the rhythm pattern memories $9_1$ to $9_n$ are described to be fixed memories (ROM's)

but may also be random access memories, whereas the selecting memory 6 and the bar number memory 7 are usually random access memories but may also be fixed memories (ROM's).

Further, while the plurality of rhythm pattern memories $9_1$ to $9_n$ are used in the embodiement, they may also be combined into one.

As has been described in the foregoing, according to this invention, desired rhythm patterns are each preselected for a desired number of bars, and the order of generation of the rhythm patterns and the numbers of bars are respectively prestored in a rhythm pattern selecting memory and a bar number memory, and in accordance with the output signals therefrom, the preselected rhythm patterns are successively generated for the preselected numbers of bars. Since it is possible to preset any combinations of rhythm patterns and the number of bar over which the rhythm patterns are each repeated, the rhythm generator of this invention exhibits the advantage of producing desired rhythms full of variety over the conventional monotonous rhythm generators.

It will be apparent that many modifications and variations may be effected without departing from the scope of the novel concepts of this invention.

What is claimed is:

1. A rhythm generator comprising:

a plurality of rhythm pattern memories to be read out in a predetermined sequence, each storing a different rhythm pattern and outputting its respective rhythm pattern in response to an addressing means;

a bar counter for counting the number of bars being read out from each sequentially read out rhythm pattern memory;

a first memory storing said predetermined sequence in which said plurality of rhythm pattern memories is to be read out;

a second memory storing the number of bars for which each rhythm pattern memory in said sequence is to be read out;

a comparator for comparing the output from the bar counter with the output from the second memory to provide a coincidence signal; and an address counter addressing said first and second memories, said address counter being responsive to the coincidence signal to increment the count value of said address counter, whereby each rhythm pattern memory in said sequence is read out for said predetermined number of bars.

* * * * *